US009571926B2

(12) United States Patent
Jianxiong et al.

(10) Patent No.: US 9,571,926 B2
(45) Date of Patent: Feb. 14, 2017

(54) HIGH-EFFICIENCY LOW-VOLTAGE-POWER-SUPPLY HIGH-POWER-OUTPUT AUDIO DRIVER ARCHITECTURE

(75) Inventors: Bai Jianxiong, Shanghai (CN); Shihao Chen, Shanghai (CN); Junxia Chen, Shanghai (CN); Sijun Chen, Shanghai (CN)

(73) Assignee: Christopher Technology (Shanghai) Limited, Shanghai (CN)

( * ) Notice: Subject to any disclaimer, the term of this patent is extended or adjusted under 35 U.S.C. 154(b) by 839 days.

(21) Appl. No.: 13/368,073

(22) Filed: Feb. 7, 2012

(65) Prior Publication Data

US 2012/0257771 A1 Oct. 11, 2012

(30) Foreign Application Priority Data

Apr. 8, 2011 (CN) ..... 2011 1 0087987

(51) Int. Cl.
*H04R 3/00* (2006.01)
*H04R 3/08* (2006.01)

(52) U.S. Cl.
CPC .. *H04R 3/00* (2013.01); *H04R 3/08* (2013.01)

(58) Field of Classification Search
CPC ..... H03F 3/217; H03F 3/68; H03F 2200/03; H03F 2200/331; H03F 2200/351; H03F 1/305; H04R 3/00; H04R 3/14; H04R 3/12; H04R 5/04; H04R 9/63; H04R 2209/041; H04R 9/063; H04R 3/08
USPC ..... 381/120, 121, 118, 117, 400, 401, 402; 330/10, 251, 207 A
See application file for complete search history.

(56) References Cited

U.S. PATENT DOCUMENTS

| | | | | |
|---|---|---|---|---|
| 5,828,767 | A * | 10/1998 | Button | 381/401 |
| 6,351,229 | B1 * | 2/2002 | Wang | 341/143 |
| 7,058,463 | B1 * | 6/2006 | Ruha et al. | 700/94 |
| 7,764,797 | B2 * | 7/2010 | Yamamoto et al. | 381/59 |
| 2009/0028371 | A1 * | 1/2009 | Bailey | 381/386 |
| 2011/0160883 | A1 * | 6/2011 | Yasuda et al. | 700/94 |

* cited by examiner

*Primary Examiner* — Xu Mei
(74) *Attorney, Agent, or Firm* — Wolf, Greenfield & Sacks, P.C.

(57) ABSTRACT

The present invention discloses a high-efficiency low-voltage-power-supply high-power-output audio driver architecture, including: a multi-coil loudspeaker; and a single-input N-output audio power amplifier configured to amplify a received digital audio signal and to output N switch signals for driving the multi-coil loudspeaker, wherein N represents the number of output channels and is a positive integer greater than or equal to 2. By implementing the above mentioned method, the requirement of the high power output under low voltage input is met; the solution improves the output power by means of combination of coils, and, in cooperation with the unique dynamic power allocation technology, the solution achieves the power balance of the multiple coils, so that the output efficiency of the audio driver is greatly improved.

14 Claims, 4 Drawing Sheets

HIGH-EFFICIENCY LOW-VOLTAGE-POWER-SUPPLY HIGH-POWER-OUTPUT AUDIO DRIVER ARCHITECTURE

This application claims the priority of Chinese Patent Application No. 201110087987.1, entitled "HIGH-EFFICIENCY LOW-VOLTAGE-POWER-SUPPLY HIGH-POWER-OUTPUT AUDIO DRIVER ARCHITECTURE", filed on Apr. 8, 2011 with State Intellectual Property Office of PRC, which is hereby incorporated by reference in its entirety.

FIELD OF THE INVENTION

The present invention generally relates to the field of audio system design, and in particular to a high-efficiency low-voltage-power-supply high-power-output audio driver architecture.

BACKGROUND OF THE INVENTION

Generally, an audio system includes an audio source, an audio power amplifier and a loudspeaker. The output power of the audio system determines the loudness of the system, namely how loud the sound is. The audio source is where the sound originates and may be divided as a digital audio source or an analog audio source according to different storage modes. The audio source for recording and processing analog signals, such as an audio signal propagating in the form of current and voltage, is the analog audio source; the digital audio source records and processes abstract binary data stream formed by permutation and combination of 0 and 1, and the data may be recovered to the analog audio signal by means of the digital to analog converter (DAC). The audio power amplifier is a component for performing power amplification on a weak audio signal to obtain a strong signal. For the audio power amplifier, a main performance index is THD+N, namely Total Harmonic Distortion plus Noise, which is also a condition for determining the rated output power of the audio power amplifier. The loudspeaker, which is also referred to as the horn, is a transducer device to transform an electrical signal into a sound signal. The performance of the loudspeaker greatly affects the tone quality.

In the audio system, with a given audio source, the output power of the audio system is mainly determined by the loudspeaker and the output power of the power amplifier.

In the audio system, the maximum audio power transferred to a specified resistive load is limited by the maximum voltage amplitude output by the audio power amplifier or the maximum amplitude of current which can be transmitted by the audio power amplifier. For most audio power amplifiers, the voltage amplitude greatly depends on the power supply voltage of the amplifier. Therefore, for a specified load, the maximum current and the output power would be determined by the voltage amplitude.

Generally, in the design of an audio amplifier, specific design object and power supply voltage should be taken into account. However, if greater power is desired for the designer of the audio system and there is limitation due to a low power supply voltage, unconventional design method may be needed. Currently, the commonly used methods are: 1) reducing the internal resistance of the loudspeaker; and 2) increasing the operating voltage of the audio power amplifier. Although these two methods can achieve the object of the high power output, there are obvious disadvantages as follows.

1) In the case of reducing the internal resistance of the loudspeaker, the current passing through the loudspeaker may increase. This method thus is limited by the overcurrent capacity of the loudspeaker and achieves limited effect on increasing the power. Since the power loss of the loudspeaker increases with increasing current, the efficiency of this method is low.

2) In the case of increasing the operating voltage of the audio power amplifier, if there is low power supply voltage, the method requires power supply conversion. However, none of the power supply conversions has an efficiency of 100%. Taking the Boost structure which has higher conversion efficiency as an example, its conversion efficiency is only 80%-95%.

Moreover, the operating voltage of the audio power amplifier is limited by the manufacture process and is impossible to increase without limit. Taking the current standard 0.34 μm process as an example, the maximum withstand voltage of a port guaranteed by this process is only 5.5V.

Therefore, the two existing solutions for improving the output power of the audio system are both achieved with efficiency loss and both have certain limitations.

SUMMARY OF THE INVENTION

The object of the present invention is to provide a high-efficiency low-voltage-power-supply high-power-output audio driver architecture, so as to solve the technical problem that it is impossible to achieve high-efficiency high-power audio output under the condition of lower power supply voltage.

In order to achieve the above object, the technical solution of the present invention is as follows:

a high-efficiency low-voltage-power-supply high-power-output audio driver architecture, including: a multi-coil loudspeaker; and a single-input N-output audio power amplifier configured to amplify a received digital audio signal and to output N switch signals for driving the multi-coil loudspeaker, wherein N represents the number of output channels and is a positive integer greater than or equal to 2.

The maximum output power of the audio driver architecture as provided by the present invention is completely determined by the total number of the output channels of the audio power amplifier, and the instantaneous power of the audio driver architecture is determined by the number of coils in operation inside the loudspeaker. By implementing the above mentioned method, the requirement of the high power output under the condition of low voltage input is met; the solution improves the output power by means of combination of coils, and, in cooperation with the unique dynamic power allocation technology, the solution achieves the power balance of the multiple coils, so that the output efficiency of the audio driver is greatly improved. This solution is clear in structure and is easy in implementation.

DETAILED DESCRIPTION OF THE INVENTION

A preferred embodiment of the present invention is provided and described in detail in reference to FIGS. 1-5 as follows, so that the function and characteristic of the present invention may be better understood.

The present invention provides a high-efficiency low-voltage-power-supply high-power-output audio driver architecture. As shown in the structural diagram of FIG. 1, the high-efficiency low-voltage-power-supply high-power-output audio driver architecture includes a single-input N-output (where N represents the number of output channels and is a positive integer greater than or equal to 2) audio amplifier 10 and a multi-coil loudspeaker 20.

Figure 1:
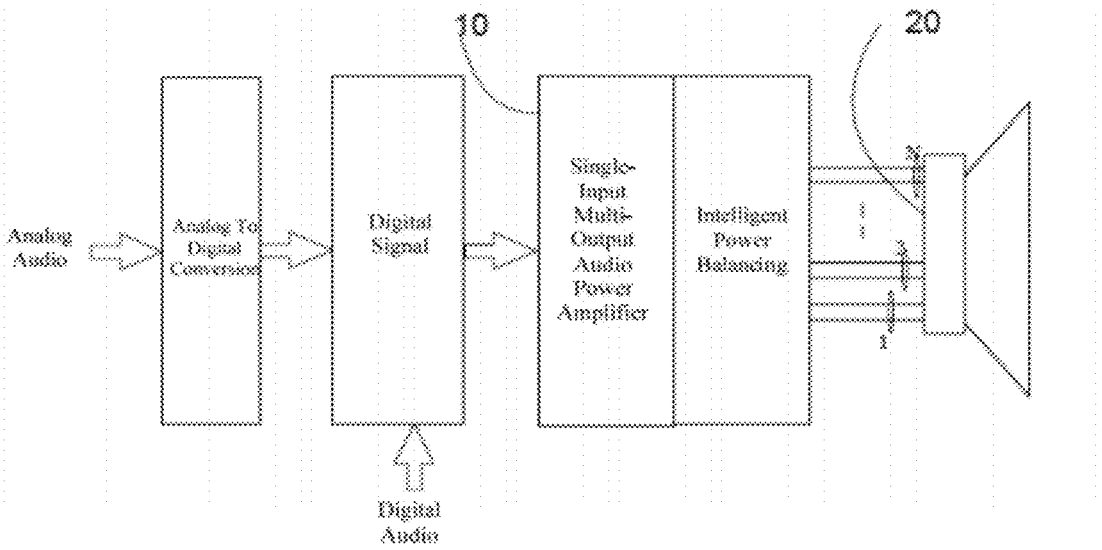
FIG. 1 is a structural design diagram of an audio system according to the present invention.
Figure 2:
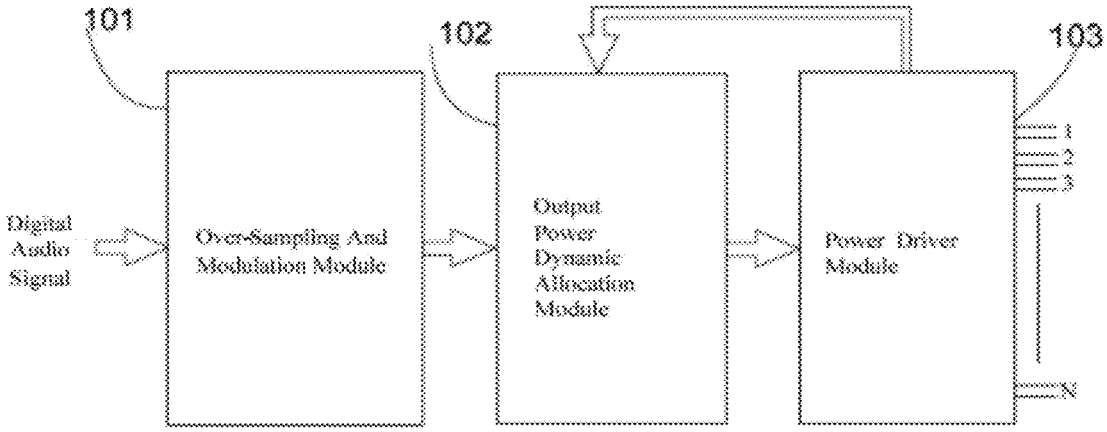
FIG. 2 is a structural diagram of a single-input multi-output audio system according to the present invention.

The single-input N-output audio amplifier 10 amplifies an audio signal and outputs N switch signals for driving the multi-coil loudspeaker. The core part of the single-input N-output audio amplifier 10 includes an over-sampling modulation unit 101, an output power dynamic allocation unit 102 and a driver unit 103, and its system structure is shown in FIG. 2. The driver unit 103 includes N Class-D audio power amplifiers capable of driving N coils, with the turn-on control signals of switch tubes being connected with output signals of the output power allocation unit; the output power dynamic allocation unit 102 allocates power in the N output channels in a dynamically balanced way by means of dynamic power detection and intercross mapping, and is used for improving the working efficiency of the driver unit; the over-sampling modulation unit 101 includes a K times over-sampling filter and a multi-bit Delta-Sigma modulation unit, and modulates an input audio signal into an N-bit control signal for controlling N coils, where the control signal may be a PWM signal or a PDM signal.

Figure 3:
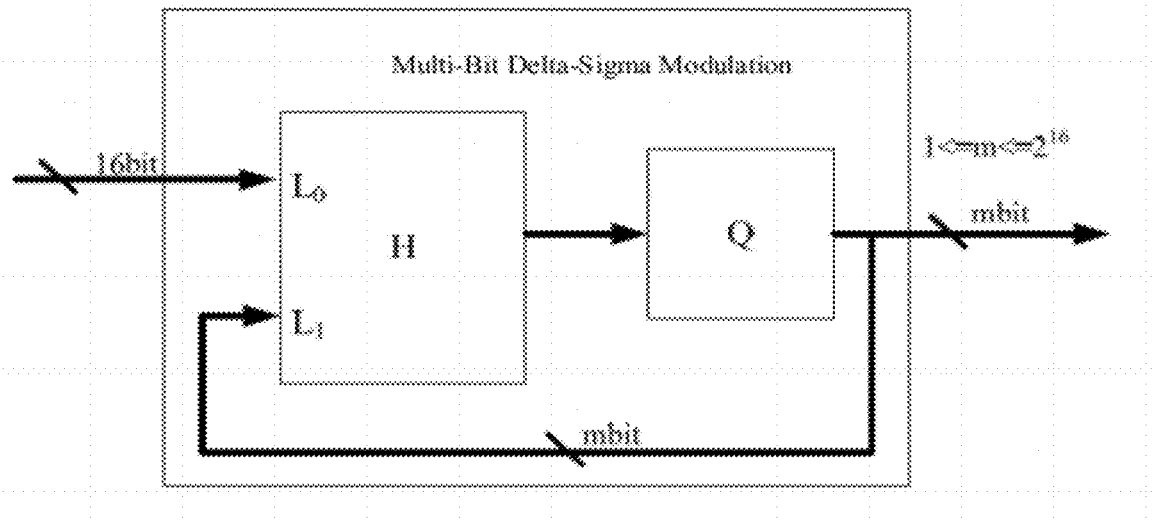
FIG. 3 is a schematic diagram of a multi-bit Delta-Sigma modulation unit according to the present invention.

FIG. 3 shows a structural diagram of the multi-bit Delta-Sigma modulation unit. The multi-bit Delta-Sigma modulation unit includes a 16-bit comparator H and a sampling circuit Q. The two input terminals of the 16-bit comparator H receive an output signal from the sampling circuit Q and a 16-bit signal respectively, and the compared output signal of the 16-bit comparator H is connected to the input terminal of the sampling circuit Q.

Figure 4:
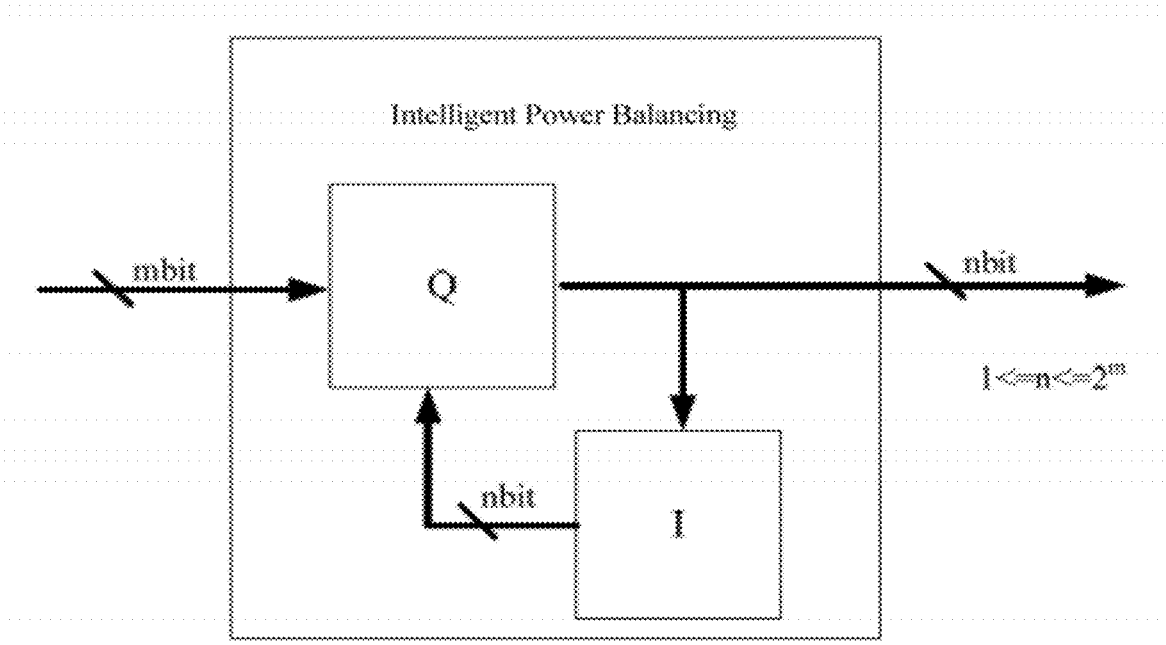
FIG. 4 is a schematic diagram of an intelligent power balancing unit according to the present invention.

FIG. 4 shows a structural diagram of the intelligent power balancing unit. The intelligent power balancing unit includes a sampling circuit Q and an encode circuit I. The intelligent power balancing unit re-encodes a signal that is modulated and output by the previous stage and dynamically allocates the power evenly into each driver stage, so that each diver stage has an accordant average output power.

Figure 5:
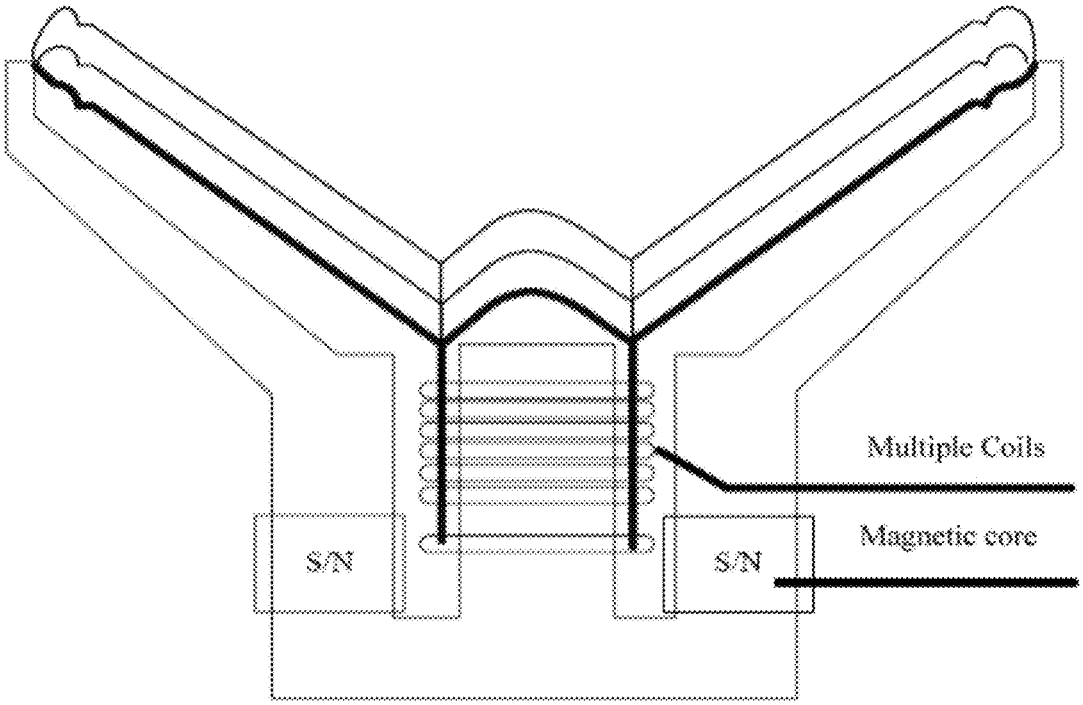
FIG. 5 is a schematic diagram of the structure of a multi-coil loudspeaker according to the present invention.

The multi-coil loudspeaker 20 is a loudspeaker internally integrated with multiple coaxially arranged coils, with each of the coils independently driving the loudspeaker to sound. FIG. 5 shows a structural diagram of the multi-coil loudspeaker. If current passes through a coil which is in a magnetic field, a current-varying magnetic field is generated. This current-varying magnetic field interacts with the magnetic field of the permanent magnet, which makes the sound coil vibrate along the axial direction.

The maximum output power of the audio system as provided by the present invention is completely determined by the total number of the output channels of the audio power amplifier, and the instantaneous power of the audio system is determined by the number of coils in operation inside the loudspeaker. For example, if a system includes a single-input N-output audio power amplifier and a loudspeaker which includes N coils, with the maximum output power of a single coil in the loudspeaker being W watts, the maximum output power of the system is N×W watts.

By implementing the above mentioned method, any power may be achieved under low voltage by rationally configuring the number of the coils in the loudspeaker. Furthermore, in the solution the dynamic power control technology is employed and thus it is ensured that each coil in the loudspeaker operates in its best condition, so that the efficiency is improved. This solution is simple and easy to implement, and thus convenient for wide application.

By implementing the present invention, the disadvantages of the prior art are overcome in the following way:

1. There is no boost for the power supply, thus power loss due to the boost is avoided. The efficiency is at least increased by 5% under equal output power.

2. The whole system operates in a low-voltage environment, and the traditional chip manufacture process can meet the requirement of the audio power diver in the system, so that the cost of the system is greatly reduced.

3. It is showed through experiments that, by implementing the present invention, the requirement of outputting high power audio signal when operating under low voltage is well met. Taking a system for driving a loudspeaker which is formed by three coils and each of the coils having a resistance of 8 ohms as an example, the output power of the system may be 4.03 watts under the operation condition of 5V input voltage and THD+N<1%.

What is described above is only a preferred embodiment of the present invention and is not intended to limit the scope of the present invention. That is to say any simple or equivalent changes and modifications made according to the claims and the description of the present application shall fall within the scope of protection of the present invention.

What is claimed is:

1. A high-efficiency low-voltage-power-supply high-power-output audio driver architecture, comprising:

a multi-coil loudspeaker having N coils; and a single-input N-output audio power amplifier configured to amplify a received digital audio signal and to output N switch signals for driving the multi-coil loudspeaker, wherein N represents the number of output channels which correspond to the N coils and is a positive integer greater than or equal to 2;

wherein the single-input N-output audio power amplifier comprises an output power dynamic allocation unit configured to dynamically allocate power into more than two of the N output channels in a balanced way by means of dynamic power detection and intercross mapping, to make output powers of the more than two of the N output channels be equal;

and wherein a driving signal of the single-input N-output audio power amplifier is fed back to the output power dynamic allocation unit, and the output power dynamic allocation unit allocates power in real time based on an operating condition of a current driver stage.

2. The high-efficiency low-voltage-power-supply high-power-output audio driver architecture according to claim 1, wherein the single-input N-output audio power amplifier further comprises:

an over-sampling modulation unit comprising an over-sampling filter and an M-bit Delta-Sigma modulation unit, the over-sampling modulation unit being configured to modulate the input digital audio signal into an N-bit control signal for controlling N coils, wherein M is a positive integer greater than or equal to 1 and less than or equal to $2^{16}$; and a driver unit configured to receive an output signal of the output power dynamic allocation unit, the driver unit comprising N Class-D audio power amplifiers;

wherein the output power dynamic allocation unit is further configured to receive an output signal of the over sampling modulation unit.

3. The high-efficiency low-voltage-power-supply high-power-output audio driver architecture according to claim 2, wherein the M-bit Delta-Sigma modulation unit comprises a 16-bit comparator and a sampling circuit, one input terminal of the 16-bit comparator receives a 16-bit signal and the other input terminal of the 16-bit comparator receives an output signal from the sampling circuit, and a compared output signal of the 16-bit comparator is connected to an input terminal of the sampling circuit.

4. The high-efficiency low-voltage-power-supply high-power-output audio driver architecture according to claim 2, wherein the N-bit control signal is a PWM signal or a PDM signal.

5. The high-efficiency low-voltage-power-supply high-power-output audio driver architecture according to claim 1, wherein the multi-coil loudspeaker is a loudspeaker internally integrated with multiple coaxially arranged coils, with each of the coils independently driving the loudspeaker to sound.

6. The high-efficiency low-voltage-power-supply high-power-output audio driver architecture according to claim 1, further comprising an analog to digital conversion unit configured to convert a received analog audio signal into a digital audio signal and to send the digital audio signal to the single-input N-output audio power amplifier.

7. The high-efficiency low-voltage-power-supply high-power-output audio driver architecture according to claim 2, wherein the N-bit control signal is a PWM signal or a PDM signal.

8. The high-efficiency low-voltage-power-supply high-power-output audio driver architecture according to claim 3, wherein the N-bit control signal is a PWM signal or a PDM signal.

9. The high-efficiency low-voltage-power-supply high-power-output audio driver architecture according to claim 2, wherein the multi-coil loudspeaker is a loudspeaker internally integrated with multiple coaxially arranged coils, with each of the coils independently driving the loudspeaker to sound.

10. The high-efficiency low-voltage-power-supply high-power-output audio driver architecture according to claim 2, wherein the multi-coil loudspeaker is a loudspeaker internally integrated with multiple coaxially arranged coils, with each of the coils independently driving the loudspeaker to sound.

11. The high-efficiency low-voltage-power-supply high-power-output audio driver architecture according to claim 3, wherein the multi-coil loudspeaker is a loudspeaker internally integrated with multiple coaxially arranged coils, with each of the coils independently driving the loudspeaker to sound.

12. The high-efficiency low-voltage-power-supply high-power-output audio driver architecture according to claim 2, further comprising an analog to digital conversion unit configured to convert a received analog audio signal into a digital audio signal and to send the digital audio signal to the single-input N-output audio power amplifier.

13. The high-efficiency low-voltage-power-supply high-power-output audio driver architecture according to claim 2, further comprising an analog to digital conversion unit configured to convert a received analog audio signal into a digital audio signal and to send the digital audio signal to the single-input N-output audio power amplifier.

14. The high-efficiency low-voltage-power-supply high-power-output audio driver architecture according to claim 3, further comprising an analog to digital conversion unit configured to convert a received analog audio signal into a digital audio signal and to send the digital audio signal to the single-input N-output audio power amplifier.

* * * * *